US006550164B2

(12) United States Patent
Rosa

(10) Patent No.: US 6,550,164 B2
(45) Date of Patent: Apr. 22, 2003

(54) IRONING BOARD WITH STEAM RECOVERY SYSTEM

(75) Inventor: Carlo Rosa, Lecco (IT)

(73) Assignee: Ariete S.p.A. (IT)

( * ) Notice: Subject to any disclaimer, the term of this patent is extended or adjusted under 35 U.S.C. 154(b) by 0 days.

(21) Appl. No.: 10/020,113

(22) Filed: Dec. 18, 2001

(65) Prior Publication Data

US 2002/0095827 A1 Jul. 25, 2002

(30) Foreign Application Priority Data

Jan. 24, 2001 (IT) ..... 2001A000003

(51) Int. Cl.[7] ..... D06F 8/08
(52) U.S. Cl. ..... 38/137
(58) Field of Search ..... 38/137, 104, 107, 38/142; 219/259, 246; 68/222

(56) References Cited

U.S. PATENT DOCUMENTS 2,527,363 A * 10/1950 Jacowitz ..... 38/104
2,645,046 A * 7/1953 Frej ..... 38/137
5,315,773 A * 5/1994 Iwami et al. ..... 38/77.6
5,669,164 A * 9/1997 Voitchovsky ..... 38/137

* cited by examiner

*Primary Examiner*—Ismael Izaguirre
(74) *Attorney, Agent, or Firm*—Larson & Taylor, PLC

(57) ABSTRACT

Ironing board comprising an iron conneted with a steam boiler and an ironing plank provided with a pierced upper surface and with a lower tank gathering the condensation water of said steam; said ironing board comprises means for recovering the condensation water which is present in the tank and means for re-circulating water from said recovery means to said steam boiler.

10 Claims, 3 Drawing Sheets

IRONING BOARD WITH STEAM RECOVERY SYSTEM

BACKGROUND OF THE INVENTION

The present invention relates to ironing boards, and in particular to a system for recovering in said ironing boards the condensation water of the steam given out by steam irons used in combination with said ironing boards and usually provided with a steam boiler endowed with a water supply reservoir and connected with said iron by means of a steam supply duct.

Ironing boards known at the latest state of the art comprise a suitable support stand on which a pierced plank is located (usually a metal plank) on which a suitable steam-permeable felt is applied, onto which the item to be ironed is laid and onto which the steam iron is glided by the user.

In a first type of known ironing boards the water steam given out by the iron during the ironing operation goes through the pad felt and gets out through the plank holes dispersing in the atmosphere.

The main disadvantage of said known ironing boards consists in that the water used to generate the steam given out by the iron is dispersed in the atmosphere, thus making it necessary to fill the boiler reservoir with fresh water quite frequently. Since said filling operation is normally carried out using drinking water, rich in limestone, the latter little by little sediments in the tank and causes dangerous encrustations.

It is also known about a second type of ironing boards, in which the holes in the ironing plank do not communicate with the outside atmosphere but with a hollow space located under the ironing plank, said hollow space being connected in its turn with a steam boiler by means of an additional duct, so as to supply steam countercurrent from below to the ironing plane, and being also endowed with an air suction fan in order to keep the items to be ironed still when actuated by the user.

However, said second known type of ironing boards has, beyond the disadvantage described above which is common to all ironing boards, a further disadvantage due to the presence of condensed water on the lower side of the plank hollow space. Said water sinks the temperature of the steam aupplied countercurrent to the table, since said steam, before reaching the ironing plane, should lick up the condensed water and exchange heat with it.

SUMMARY OF THE INVENTION

The aim of the present invention is to avoid the disadvantages of known ironing boards as previously mentioned.

Such aim is reached by the present invention by means of an ironing board comprising an iron connected with a steam boiler and an ironing plank provided with a pierced upper surface and with a lower tank gathering the condensation water of said steam; said ironing board is provided with means for recovering the condensation water which is present in the tank and with means for re-circulating water from said recovery means to said steam boiler.

BRIEF DESCRIPTION OF THE DRAWINGS

Further aims and advantages of the present invention will be better understood thanks to the following description, considered as a mere non limiting example and referring to the enclosed drawings, in which.

DESCRIPTION OF THE PREFERRED EMBODIMENTS OF THE INVENTION

Figure 1:
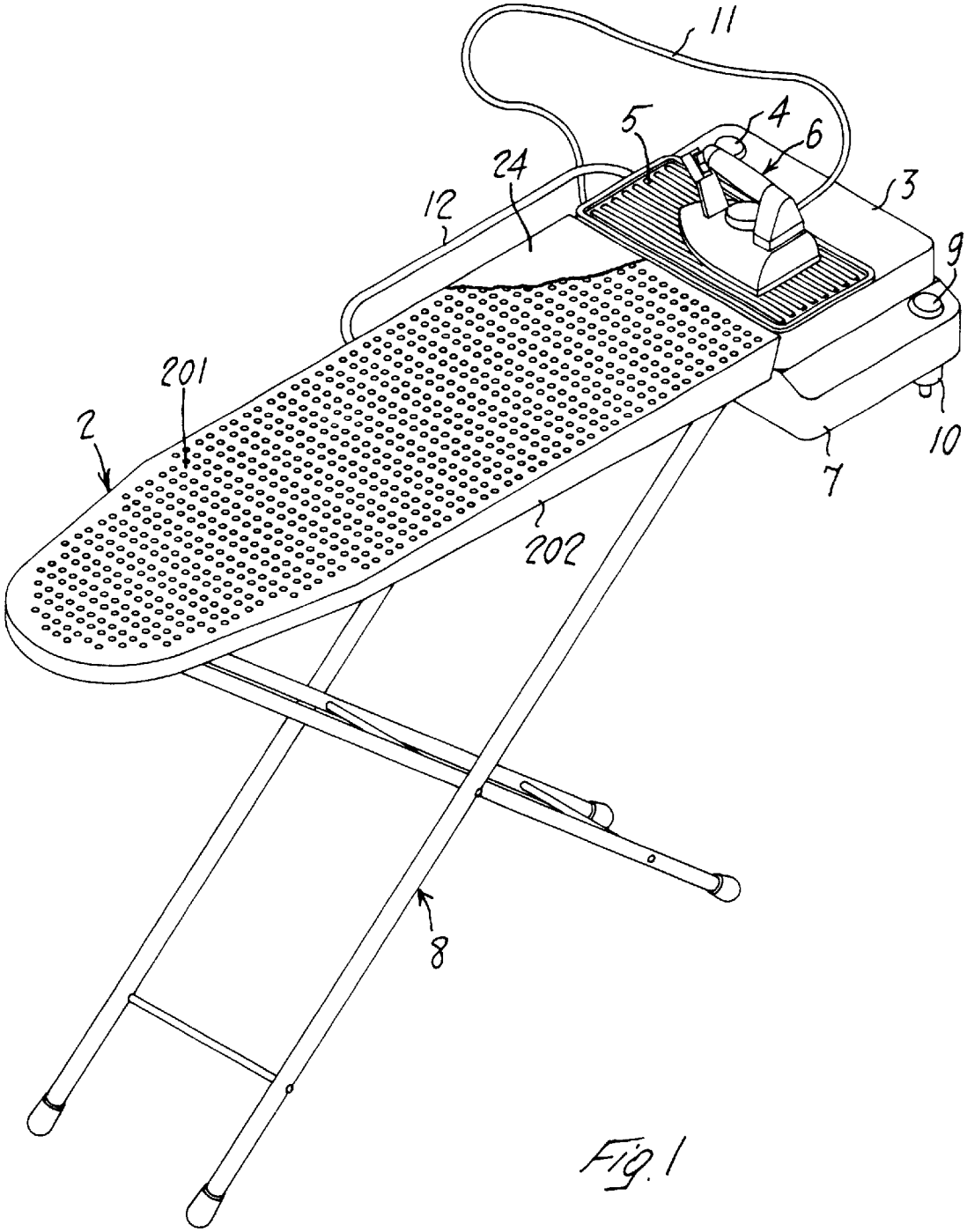
FIG. 1 is a perspective view of an embodiment of an ironing board according to the present invention.

FIG. 1 shows a ironing board according to the present invention, consisting of an ironing plank 2 supported by a stand 8 standing on the ground and provided with a pierced flat upper surface 201 and with a lower tank 202 with an inclined bottom. A suitable steam-permeable felt layer 24 (a small section of which is shown in the figure) is applied onto said upper surface 201, onto said layer the item to be ironed being laid and a steam iron 6 being glided by the user. A pressure boiler 3 is fastened beside said lower tank 202, said boiler being endowed with a safety plug 4 and a support base 5 for said iron 6 being located on it. A reservoir 7 containing the supply water for said boiler 3 is fastened onto the lower portion of the pressure boiler 3. Said reservoir 7 is provided on the top with a filling plug 9 and on the bottom with a drain cock 10. The pressure boiler 3 therefore receives water from the reservoir 7, turns it into steam and supplies the iron 6 with said steam through a duct 11 and the plank 2 through a duct 12.

Figure 2:
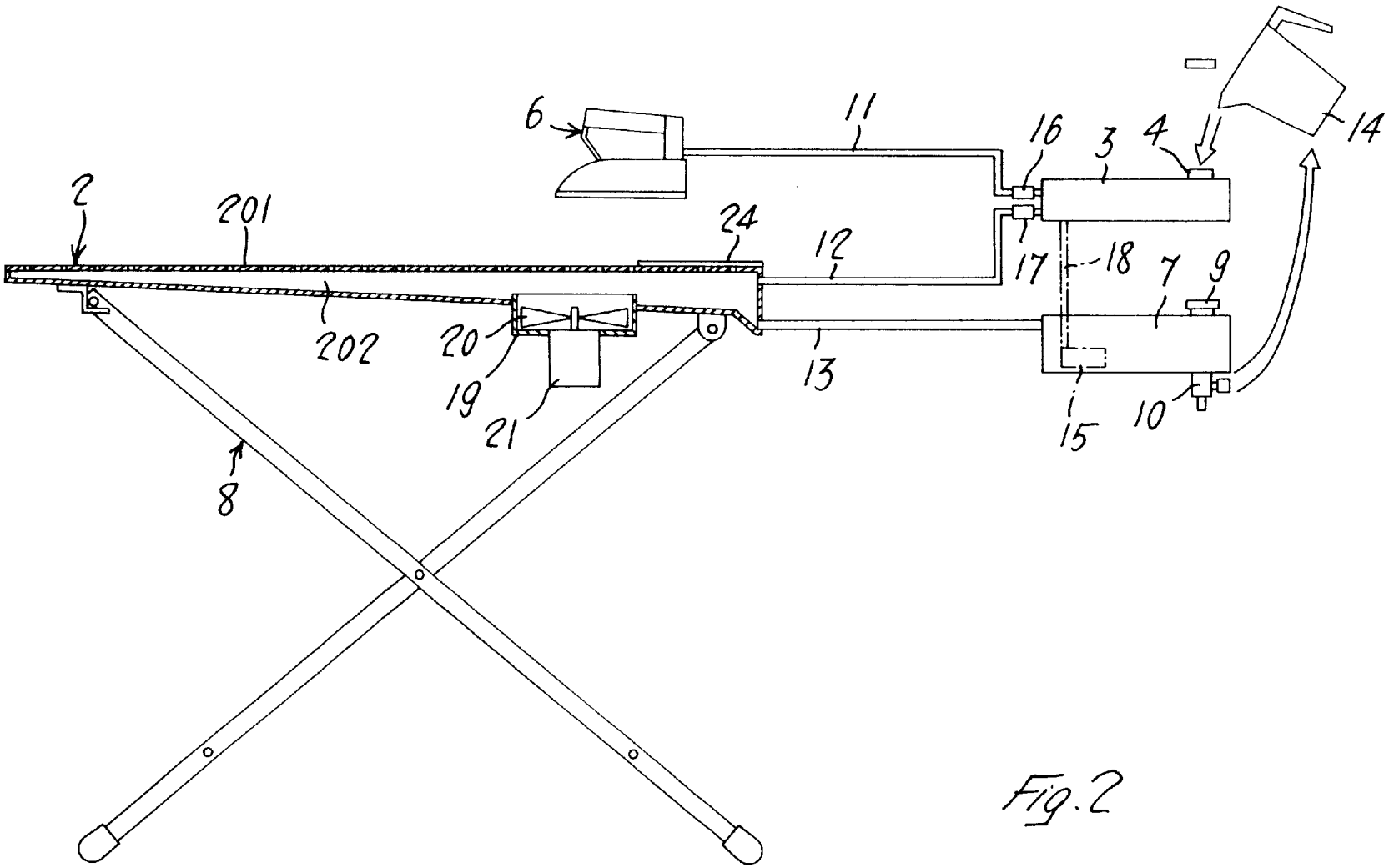
FIG. 2 is a schematic lateral view, partially sectioned, showing the working of the ironing board of FIG. 1.

FIG. 2 schematically show the ironing board of FIG. 1. The bottom of the tank 202 is inclined so that the condensation water gathers towards a lower area provided with the connection of the end of a duct 13 supplying the reservoir 7 with such condensation water. A seat 19 housing a steam suction fan 20 driven by a motor 21 is further provided on said bottom. Said fan 20 should suck up air when required by the user, so as to keep the items to be ironed still. The condensation water, gathered within the reservoir 7 through the duct 13, can be discharged into an outer vessel 14 by means of the cock 10 and re-introduced in a demineralized state into the pressure boiler 3 through the plug 14. Instead of said outer vessel 14, the reservoir 7 can be provided inside with a pump 15 (indicated with a hatched line) sending directly the water recovered from the plank 2 from said reservoir 7 to the boiler 3 through a duct 18. Said pump 15 could obviously also be located outside said reservoir 7. The delivery of pressure steam from the boiler 3 is controlled by a pair of electrovalves 16 and 17, located within the duct 11 for supplying the iron 6 with steam and within the duct 12 for supplying the plank 2 with steam, respectively.

Figure 3:
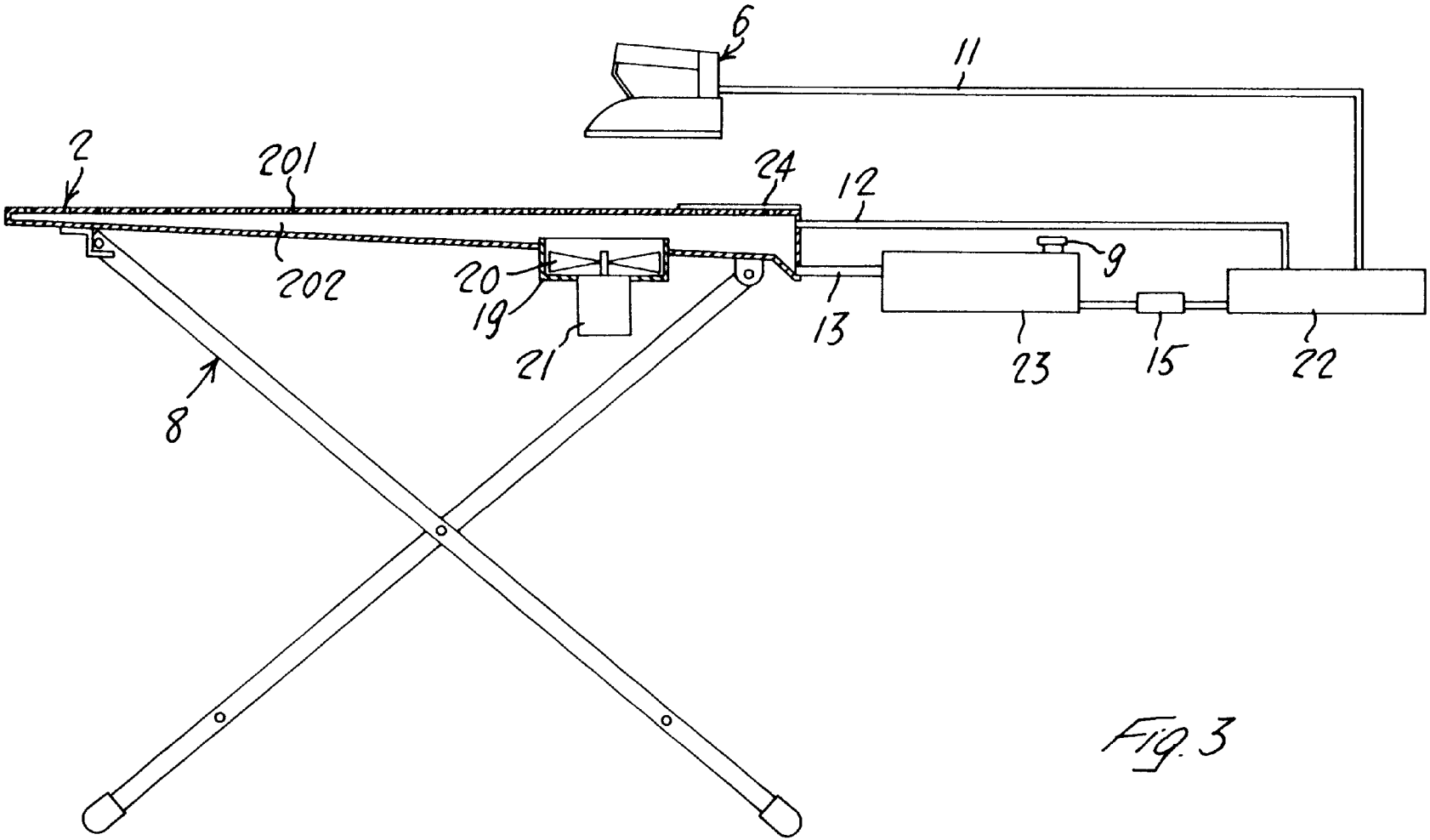
FIG. 3 is a schematic lateral view, partially sectioned, showing an execution variant of the ironing board according to the present invention.

An execution variant of the present ironing board is shown in FIG. 3 and provides for the application of a low pressure steam boiler 22 receiving directly water recovered from a reservoir 23 thanks to a pump 15 which can also be placed within said reservoir 15 (therefore immersed in the recovered water). If compared with the solution providing for the pressure boiler 3, the steam boiler 22 can immediately vaporize the water received from the reservoir 23 without waiting for a certain amount of water to be gathered, and can therefore be carried out with a smaller size with respect to the aforesaid boiler 3. When the person using the iron 6 requires steam, the pump 15 is operated so as to transfer the water recovered from the reservoir 23 to the low pressure steam boiler 22 and from here to the iron 6 or to the plank 2.

I claim:

1. An ironing board of the kind comprising an iron connected with a steam boiler and an ironing plank provided with a pierced upper surface and with a lower tank gathering the condensation water of said steam, further comprising means for recovering the condensation water which is present in the said lower tank and means for re-circulating said condensation water from said recovery means to said steam boiler.

2. The ironing board according to claim 1, wherein the said lower tank for gathering condensation water comprises a bottom with a suitable inclination and connected near its lower area with said recovery means.

3. The ironing board according to claim 1, wherein the condensation water coming from the said tank is gathered within at least one intermediate reservoir and transferred to said steam boiler through said water re-circulation means.

4. The ironing board according to claim 3, further comprising a pump for re-circulating water from said intermediate reservoir to the steam boiler, said pump being placed inside or outside said reservoir.

5. The ironing board according to claim 1, in which the said steam generator is a pressure boiler into which water is manually introduced by means of a suitable vessel, and said means for recovering the condensation water are in the form of an intermediate reservoir provided with a cock for discharging condensation water into said vessel.

6. The ironing board according to claim 4 in which the said steam generator is in the form of a boiler, and the recovered condensation water is introduced into said boiler through a duct connected to said re-circulation pump connested to the said intermediate reservoir.

7. The ironing board according to claim 5, in which said boiler supplies the said iron and the said plank with steam through two ducts, each of which comprises at least an electrovalve controlling the steam supply.

8. The ironing board according to claim 1, in whcih the said steam generator is in the form of a low pressure steam boiler, and in which the said means for recovering the condensation water are in the form of an intermediate reservoir, said low pressure steam boiler immediately generating steam starting from the condensation water taken from the said intermediate reservoir through a pump and transferring said steam to the said iron and to the said plank by means of two ducts.

9. The ironing board according to claim 1, further comprising means for sucking up steam from the said lower tank of the said ironing plank.

10. The ironing board according to claim 9, in which said means steam sucking means comprise a suction fan housed in a seat formed on the bottom of the said tank and driven by a suitable motor.

* * * * *